US005951781A

United States Patent [19]

Lucas

[11] Patent Number: 5,951,781

[45] Date of Patent: Sep. 14, 1999

[54] PAINT SCRAPER AND ASSOCIATED METHOD

[76] Inventor: Gary H. Lucas, 14 Maple Ave., Hightstown, N.J. 08520

[21] Appl. No.: 09/042,941

[22] Filed: Mar. 17, 1998

[51] Int. Cl.[6] ..... A47L 13/02; A47L 13/022

[52] U.S. Cl. ..... 134/6; 15/144.3; 15/236.01; 15/401; 403/53

[58] Field of Search ..... 15/144.1, 144.2, 15/144.3, 236.01, 401; 114/222; 30/169; 403/53, 79, 119; 134/6

[56] References Cited

U.S. PATENT DOCUMENTS

| | | | |
|---|---|---|---|
| 740,087 | 9/1903 | Carleton | 15/144.2 |
| 4,204,292 | 5/1980 | Lester et al. | 15/28 |
| 4,663,796 | 5/1987 | Helling et al. | 15/144.2 |
| 4,738,433 | 4/1988 | Hoff | 254/30 |
| 4,909,173 | 3/1990 | Strong | 114/222 |
| 4,929,112 | 5/1990 | Wilcox | 15/144.2 |
| 4,991,533 | 2/1991 | Sterling | 114/222 |
| 5,022,632 | 6/1991 | Beideck | 254/30 |
| 5,179,754 | 1/1993 | Stradnick | 15/236.01 |
| 5,209,176 | 5/1993 | Pompei et al. | 114/222 |
| 5,685,251 | 11/1997 | Halko | 114/222 |

FOREIGN PATENT DOCUMENTS

| | | | |
|---|---|---|---|
| 0311583 | 12/1989 | European Pat. Off. | 15/403 |
| 2373366 | 8/1978 | France | 15/144.2 |
| 1095298 | 12/1967 | United Kingdom | 15/144.1 |
| 2142525 | 1/1985 | United Kingdom | 15/144.1 |

*Primary Examiner*—Mark Spisich
*Assistant Examiner*—Theresa T. Snider
*Attorney, Agent, or Firm*—R. Neil Sudol; Henry D. Coleman

[57] ABSTRACT

A paint removal device includes a post member having two ends, a lever member having two ends, a joint connecting an end of the post member to the lever member at a point therealong spaced from the ends of the lever member, and a scraper blade provided on the lever member at one end thereof. The joint permits pivoting of the second elongate member about at least two distinct axes. In using the scraper device for removing paint from a surface facing at least partially downwardly, a lower end of the post member is planted on a ground or floor surface below the painted surface. The user pivots the lever member at the joint to place the scraper blade in contact with the painted surface. Thereafter, the user pulls on the lever member to pivot the post member and the lever member about an axis passing through the lower end of the post member. While pulling on the lever member, the user maintains the scraper blade in forceful contact with the painted surface, to thereby scrape paint from the painted surface.

15 Claims, 2 Drawing Sheets

52
26
22
30
28
36
34
32
32
34
28
22
26
24
40
46
50
42
12
20
16
14
18
54

30
28
32
34
36
39
52
26
22
48
24
44
40
42
38
12
16
14
18

PAINT SCRAPER AND ASSOCIATED METHOD

BACKGROUND OF THE INVENTION

This invention relates to a paint scraper. This invention also relates to an associated method for removing paint from a painted surface. More particularly, this invention is especially useful in removing paint from the hull of a boat.

Generally, boat hulls are painted with coating compositions which are toxic to barnacles and other sea creatures. These boat hulls must be periodically cleaned and repainted owing to degradation of the paint layer.

There are four commercially available techniques for removing paint from boat hulls. A chemical paint remover may be applied to lift the paint from the surface of the hull. A disadvantage of this technique is the extreme toxicity of the paint remover compositions. Where one is working under a boat hull, the paint remover can drip or splatter down onto the arms, hands and face of the user. Another disadvantage of the chemical approach is cost. Chemical paint removal compositions can cost upwards of $40 per gallon, making the repainting markedly expensive.

Another known technique for removing paint from boat hulls is power sanding. This technique produces clouds of fine dust particles which are toxic to plant and animal life. The dust cannot possibly be captured either during or after a sanding operation. The dust kills plant life around marinas and is toxic to marine life, as well. Of course, the dust cannot be expected to have a beneficent effect on the user.

Another technique, sand blasting, has essentially the same limitations as power sanding.

The principal way to remove paint from a boat hull is scraping the paint off of the hull. This technique greatly reduces the release of paint particles into the air and distribution of the paint over the surrounding area. The paint is removed in chips or flakes which are easier to capture and collect than dust particles.

For individual boat owners, the cleaning of a boat hull with conventional paint scrapers is a daunting task. Generally, one uses a dry dock support to elevate the boat over a ground or floor surface. To remove the paint, one crouches or kneels beneath the boat and pushes a scraper upwardly against the boat hull surface while pulling the scraper across the surface. Frequently, it is extremely difficult to generate the requisite force to separate the old paint and any collected marine debris from the boat hull. Even if one is successful, the task is markedly fatiguing, both because of the unusual position but also because of the scraping force required. Moreover, the paint chips fly down on one's face and clothes, which is not only distracting and irritating but also possibly dangerous.

Clearly, a need exists for a paint scraper which is effective for removing paint from downwardly facing surfaces such as boat hulls.

OBJECTS OF THE INVENTION

An object of the present invention is to provide a paint scraper device.

It is a more specific object of the present invention to provide a device for removing paint from downwardly facing surfaces such as boat hulls.

A more specific object of the present invention is to provide such a device which facilitates the removal of paint from downwardly facing surfaces such as boat hulls.

It is an additional object of the present invention to provide such a device which is easy to use and inexpensive to manufacture.

A further object of the present invention is to provide a method for clearing a downwardly facing surface such as a boat hull of paint and accumulated marine debris.

Yet another object of the present invention is to provide such a method which is easy and effective.

These and other objects of the present invention will be apparent from the drawings and descriptions hereof.

SUMMARY OF THE INVENTION

A paint removal device comprises, in accordance with the present invention, a first elongate member having two ends, a second elongate member having two ends, a joint connecting an end of the first elongate member to the second elongate member at a point therealong spaced from the ends of the second elongate member, and a scraper blade provided on the second elongate member at one end thereof. The joint permits pivoting of the second elongate member about at least two distinct axes.

Generally, the joint connects the upper end of the first elongate member to a middle section of the second elongate member. The first elongate member is a pole or post while the second elongate member is a lever.

In preferred embodiments of the present invention, the joint includes structure enabling pivoting of the lever member relative to the post member about the two distinct axes only. The axes are oriented substantially perpendicularly to one another and to the post member.

In one embodiment of the invention, the lever member has a longitudinal axis and the joint structure includes a collar, the lever member traversing the collar so that the lever member is rotatable about the longitudinal axis. The longitudinal axis of the lever member is one of the distinct axes.

In this one embodiment of the invention, the joint structure further includes a pin connected to the post member and the lever member, the pin being fixed against translation relative to the post member and the lever member.

In another embodiment of the present invention, the joint structure includes a pair of pins oriented at right angles to one another, the pins being spaced respective distances from the longitudinal axis of the lever member. In this case, the joint structure further includes a pair of C- or U-shaped brackets each receiving a respective one of the pins.

In accordance with another feature of the present invention, the lever member is provided at the one end with a receptacle for receiving paint scrapings. The lever member may be further provided at the one end with a coupling for connecting a hose to the lever member so that the hose communicates with the receptacle.

A method utilizing the above described scraper device for removing paint from a surface facing at least partially downwardly comprises, in accordance with the present invention, planting a lower end of the post member on a ground or floor surface below an at least partially downwardly facing painted surface. The user pivots the lever member at the joint to place the scraper blade in contact with the painted surface. Thereafter, the user pulls on the lever member to pivot the post member and the lever member about an axis passing through the lower end of the post member. While pulling on the lever member, the user maintains the scraper blade in forceful contact with the painted surface, to thereby scrape paint from the painted surface.

Where the joint defines a first rotation axis and a second rotation axis oriented perpendicularly to one another and to the post member, where the first rotation axis is oriented parallel to the lever member, and where the second rotation axis is oriented substantially perpendicularly to the lever member, the pivoting of the lever member about the joint includes pivoting the lever member about the second rotation axis. The method further comprises pivoting the lever member about the first rotation axis to maximize engagement between the scraper blade and the painted surface.

The pivoting of the second elongate member about the first rotation axis may be executed prior to the pulling on the second elongate member. In this case, the scraper blade's contact with the painted surface is optimized prior to a scraping stroke. The scraper device may be used so as to follow a curve in the painted surface. Where the curve is an upward curve, the scraper blade follows the curve because of pivoting pressure on the lever member about an axis oriented perpendicularly to both the post member and the lever member. Where the curve is a sideways or lateral curve, the scraper blade follows the curve because of pivoting pressure on the lever member about an axis oriented parallel to the lever member. In either case, the turning of the lever member during a scraping stroke maintains desired contact between the scraper blade and the painted surface.

In a preferred embodiment of the method, the painted surface is a surface of a boat hull, while the method further comprises elevating the boat hull above the ground or floor surface prior to the planting of the post member on the ground or floor surface.

In accordance with another feature of the present invention, the method further comprises attaching a hose to the one end of the lever member and suctioning paint scraping through the hose during a paint scraping procedure.

A device in accordance with the present invention for removing paint from downwardly facing surfaces such as boat hulls facilitates the paint removal process. The device is easy to use and inexpensive to manufacture. The associated method is easy and effective.

DESCRIPTION OF THE PREFERRED EMBODIMENTS

Figures 1, 2, 3:
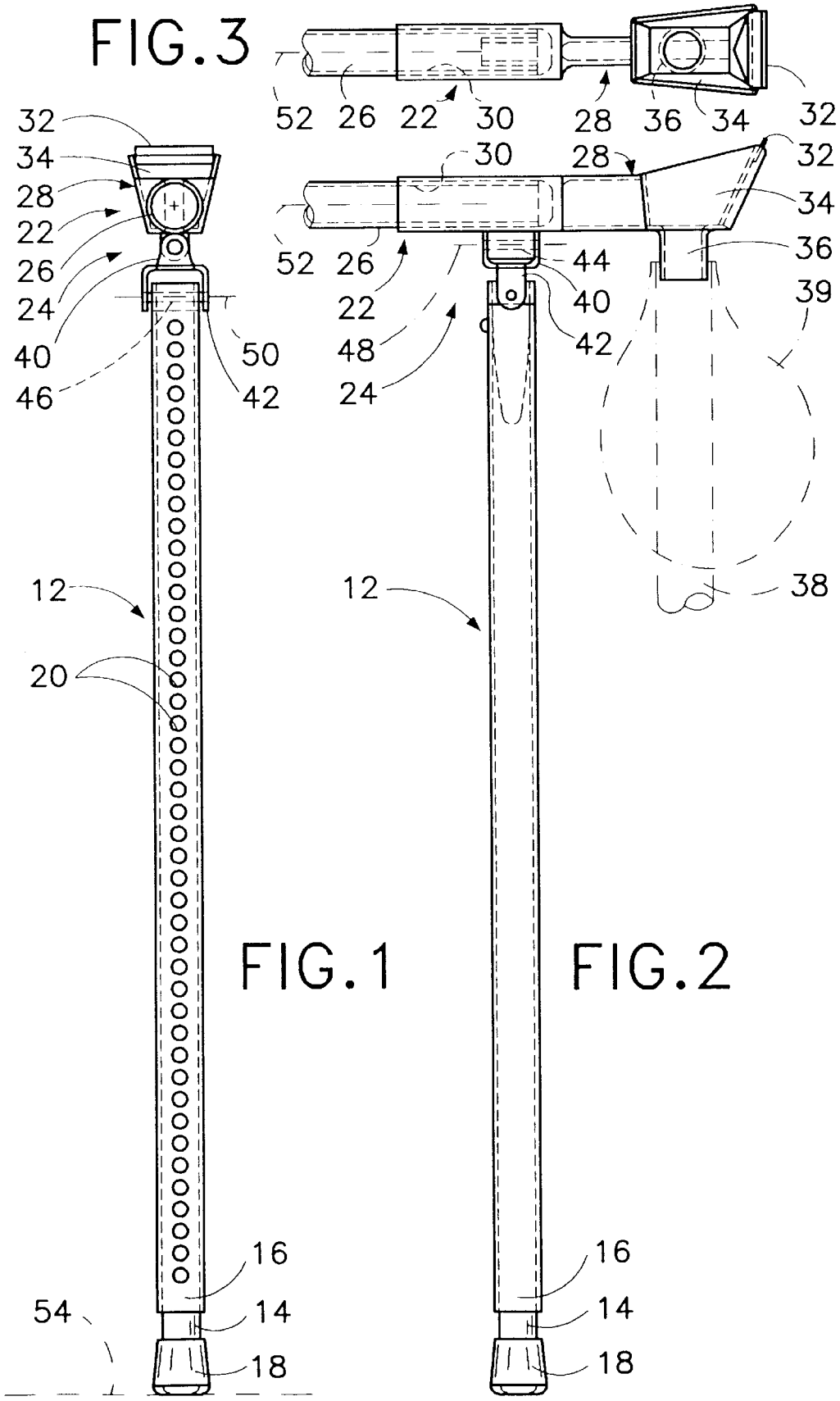
FIG. 1 is a rear elevational view of a paint scraping device in accordance with the present invention.
FIG. 2 is a partial side elevational view of the paint scraping device of FIG. 1.
FIG. 3 is a partial top view of the paint scraping device of FIGS. 1 and 2.

As illustrated in FIGS. 1–3, a paint scraping device comprises an elongate telescoping post member 12 having an aluminum inner tube 14 and an aluminum outer tube 16. Inner tube 14 is slidably inserted inside outer tube 16 and is provided at a lower end with a rubber or polymeric end cap 18. One of the tubes 14 and 16, for example, outer tube 16, is provided with a plurality of aligned apertures 20 which cooperate with a snap button in the inner tube 14 to lock inner tube 14 and outer tube 16 to one another in any of a plurality of axially offset positions to enable a user to vary the length of post member 12. The snap button is a commercially available spring loaded ball.

At an upper end of outer tube 16, post member 12 is connected to an elongate lever member 22 via a joint 24. Lever member includes a handle portion 26 at one end and a scraper portion 28 at an opposite end. Scraper member 28 receives handle portion 26 in a recess 30 and is provided at a free end, opposite recess 30, with a scraper blade 32. Scraper blade 32 is located along an edge or rim of a cup or receptacle 34 provided in scraper portion 28 of lever member 22. A coupling pipe stub 36 is provided on scraper portion 28 at receptacle 34 for connecting lever member 22 to a hose 38 so that the hose communicates with receptacle 34 to enable a vacuum or suction removal of dust and paint scrapings from the receptacle during a paint scraping operation. Alternatively or additionally, a bag 39 may be connected to pipe stub 36 for temporarily storing dust and paint scrapings.

Joint 24 includes a pair of interconnected U-shaped sheetmetal brackets 40 and 42 and a pair of pivot pins 44 and 46. Bracket 40 faces upwardly and receives pin 44, while bracket 42 faces downwardly and receives pin 46. Pins 44 and 46 are oriented at rights angles to one another and define respective rotation or pivot axes 48 and 50 of lever member 22 relative to post member 12. Axis 48 extends parallel to a longitudinal axis 52 of lever member 22, while axis 50 is oriented perpendicularly to lever member 22. Both axes 48 and 50 are spaced from longitudinal axis 52. Pins 44 and 46 are fixed against translation (linear motion) relative to post member 12, particularly outer tube 16 of post member 12, and relative to lever member 22.

To scrape paint and encrusted marine debris such as barnacles from a boat hull, a user plants the lower end of post member 12, particularly end cap 18 of inner tube 14, on a ground or floor surface disposed below a generally downwardly facing surface of a boat hull. In this procedure, of course, the boat is first elevated over the ground or floor surface, for example, in a dry dock arrangement. After planting of post member 12 on the ground or floor surface, the user grips handle portion 26 of lever member 22 and rotates the lever member about pin 46 and axis 50 so that scraper blade 32 is in adequate contact with the painted, generally downwardly facing surface of the boat hull. Depending on the angle of the hull surface at the point of contact, it may be necessary or advisable for the user to additionally turn lever member 22 about pin 44 and axis 48, to optimize contact of scraper blade 32 with the hull surface. In addition, it is recommended that, prior to the contact of scraper blade 32 with the painted boat hull, that post member 12 be angled away from the user. Thus, immediately after the planting of post member 12, the user pushes on handle portion 26 of lever member 22 to shift scraper portion 28 and scraper blade 32 away from the user so that post member 12 is not vertical.

After establishing contact between scraper blade 32 and the boat hull surface, the user pulls on handle portion 26 of lever member 22 to pivot the entire device about an axis 54 essentially passing through the lower end of inner tube 14. Simultaneously, the user is pressing downwardly on handle portion 26 to maintain scraper blade 32 in forceful engagement with the painted undersurface of the boat hull. Thus, scraper blade 32 is dragged along the boat hull surface under a leveraged force. It is contemplated that the user terminates the paint removal stroke when post member 12 has achieved an approximately upright orientation. The scraper blade has removed a strip of paint and marine debris which is about 4 to 6 inches long.

Post member may be tilted slightly to the right or left of the user in successive paint scraping strokes to increase the width of the area stripped by the paint scraping device at one location of end cap 18. Generally, however, to maximize the force applicable to the scraping process, post member 12 should be at least nearly vertical during a scraping stroke.

Hose 38 may be connected to scraper portion 28 via pipe stub 36 prior to the scraping procedure. During the scraping of a boat hull, a vacuum may be applied to hose 38 to suction dust and paint scrapings from receptacle 34.

The paint scraping device of FIGS. 1 and 2 has a storage configuration in which lever member 22 is pivoted about pin 46 and axis 50 so that the lever member is substantially parallel to post member 12. Of course, a more compact storage may be effectuated, for example, by removing handle portion 26 from recess 30 in scraper portion 28. Generally, handle portion 26 is inserted in a friction fit into recess 30. A screw may be provided, if necessary to ensure a secure connection between handle portion 26 and scraper portion 28.

Figure 4:
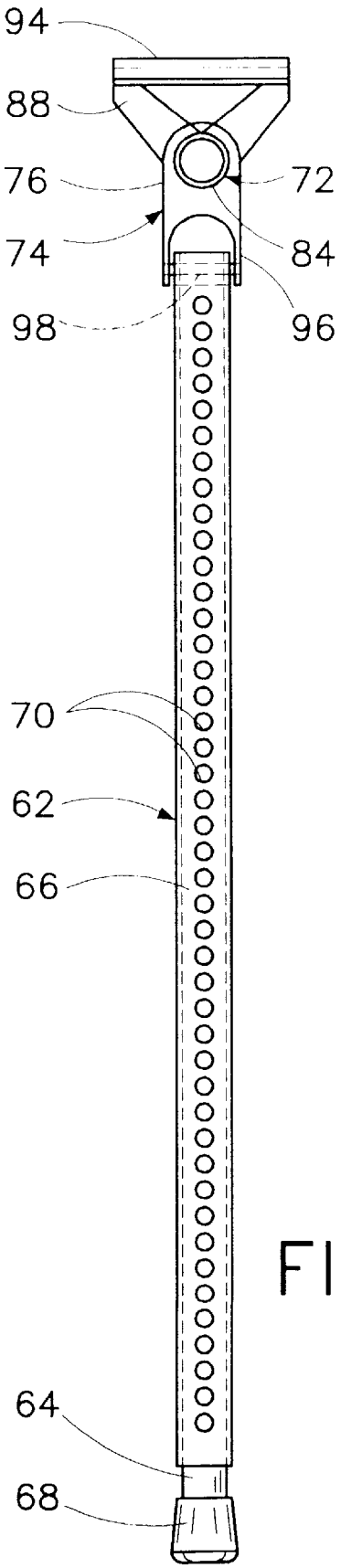
FIG. 4 is a rear elevational view of another paint scraping device in accordance with the present invention.
Figure 5:
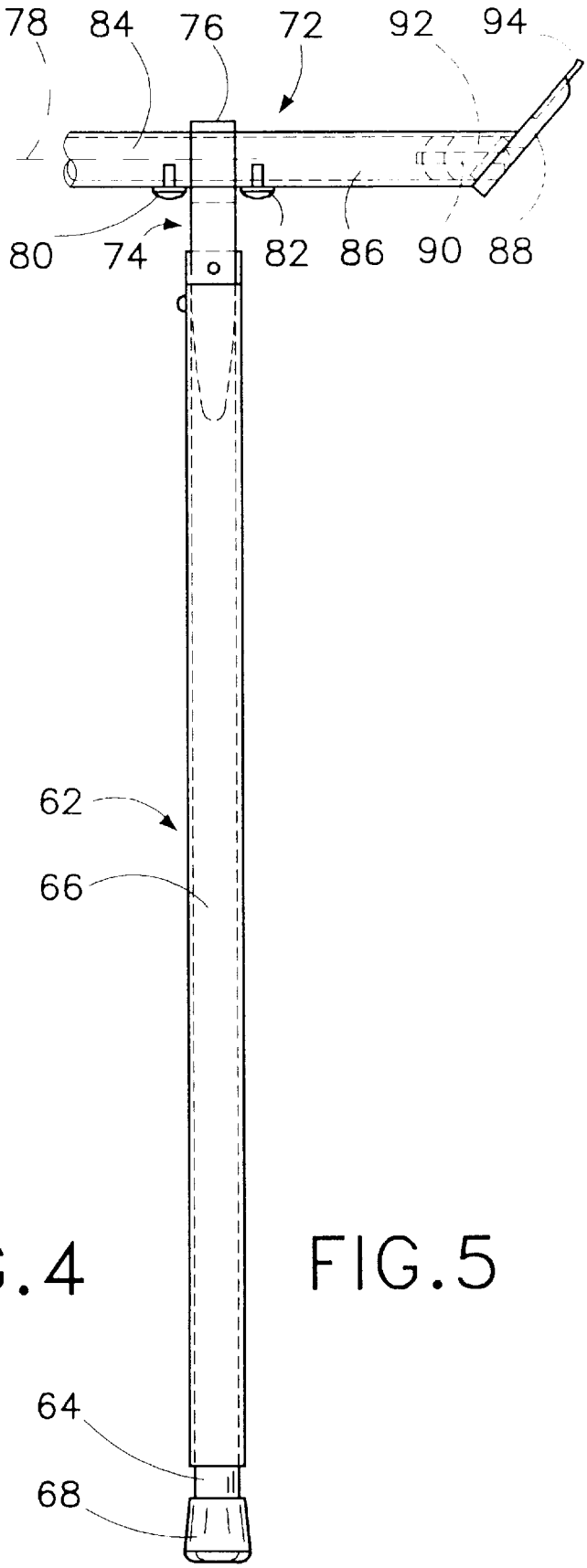
FIG. 5 is a side elevational view of the paint scraping device of FIG. 4.

As depicted in FIGS. 4 and 5, another paint scraping device includes an elongate telescoping post member 62 having an aluminum inner tube 64 slidably disposed in an aluminum outer tube 66. A lower end of inner tube 64 carries a rubber or polymeric end cap 68. Outer tube 66 is formed with multiple openings 70 in a linear array. The openings cooperate with a snap button (not shown) in inner tube 64 to lock inner tube 64 to outer tube 66 in any of a plurality of axially offset positions to enable a user to vary the length of post member 62.

At an upper end of outer tube 66, post member 62 is connected to an elongate lever member 72 via a joint 74. Joint 74 includes a collar 76 traversed by lever member 72. Lever member 72 can be rotated in collar 76 about a longitudinal axis 78 of the lever member. A pair of pan head sheetmetal screws 80 and 82 screwed to lever member 72 prevent a translation or longitudinal motion of the lever member relative to collar 76. Collar 76 functionally divides lever member 72 into a handle portion 84 and a scraper portion 86. A scraper plate 88 secured to an end of lever member 72 via a bolt 90 and a tube end fastener 92 carries a scraper blade or edge 94.

Joint 74 further includes a bracket 96 which is integral with collar 76 and which receives a pivot pin 98 fastened to an upper end of outer tube 66 of post member 62.

The paint scraping device of FIGS. 4 and 5 is used in substantially the way as the paint scraping device of FIGS. 1–3. Thus, where a boat hull has been positioned in an elevated location relative to a ground or floor surface, a user plants end cap 68 at the lower end of post member 62 on the ground or floor surface below the boat hull. Via handle portion 84, the user then grasps lever member 72 and rotates the lever member about pin 98 so that scraper blade 94 engages the painted, generally downwardly facing surface of the boat hull. Lever member 72 may be rotated about its longitudinal axis 78, prior to blade engagement with the boat hull, to optimize contact of scraper blade 94 with the hull surface. As discussed above, post member 62 is best angled away from the user at the commencement of a scraping stroke. The scraping stroke is executed by pulling on handle portion 84 of lever member 72 to pivot the entire device about an the lower end of inner tube 64 and by simultaneously pressing downwardly on handle portion 84 to maintain scraper blade 94 in forceful engagement with the painted undersurface of the boat hull. The paint scraping stroke is terminated generally once post member 12 has achieved an approximately upright orientation and the scraper blade has removed a strip of paint and marine debris which is about 4 to 6 inches long.

The storage configuration of the paint scraping device of FIGS. 4 and 5 is somewhat more compact than the storage configuration of the device of FIGS. 1–3, owing to the structure of joint 74. Moreover, because lever member 72 rotates from side to side (relative to the user) about its own longitudinal axis 78, it is easier to keep blade or edge 94 than blade 32 in contact with a boat hull surface.

Generally, joints 24 and 74 connect the upper ends of post members 12 and 62 to middle sections of lever members 22 and 72.

Although the invention has been described in terms of particular embodiments and applications, one of ordinary skill in the art, in light of this teaching, can generate additional embodiments and modifications without departing from the spirit of or exceeding the scope of the claimed invention. For example, dust-collecting receptacle 34 may be provided in the embodiment of FIGS. 4 and 5. Joint 24 or 74 may be replaced with a ball-and-socket-type universal joint. In addition, the scraper of the present invention may be used to scrape vertical surfaces, provided that a ledge or other abutment is available for bracing or stopping the lower end of post 12 or 62. The technique is substantially the same as described above, except that there may be an additional slant to the post 12 or 62, depending on the height of the painted vertical surface above the level of the ledge or abutment.

Accordingly, it is to be understood that the drawings and descriptions herein are proffered by way of example to facilitate comprehension of the invention and should not be construed to limit the scope thereof.

What is claimed is:

1. A paint removal device comprising:

a first elongate member having two ends;

a second elongate member having two ends;

a joint connecting an end of said first elongate member to said second elongate member at a single fixed location therealong spaced from the ends of said second elongate member, said joint permitting pivoting of said second elongate member about at least two distinct axes and said joint including a fixation element preventing translation of said second elongate member relative to said first elongate member; and a scraper blade provided on said second elongate member at one end thereof.

2. The device set forth in claim 1 wherein said joint includes structure enabling pivoting of said second elongate member relative to said first elongate member about two distinct axes only, said axes being oriented substantially perpendicularly to one another and to said first elongate member.

3. The device set forth in claim 2 wherein said second elongate member has a longitudinal axis and said structure includes a collar, said second elongate member traversing said collar so that said second elongate member is rotatable about said longitudinal axis, said longitudinal axis being one of said two distinct axes.

4. The device set forth in claim 3 wherein said structure further includes said fixed element, said fixed element being a pin connected to said first elongate member and said second elongate member.

5. The device set forth in claim 2 wherein said second elongate member has a longitudinal axis, said structure including a pair of pins oriented at right angles to one another, said pins being spaced respective distances from said longitudinal axis.

6. The device set forth in claim 5 wherein said structure further includes a pair of C- or U-shaped brackets each receiving a respective one of said pins.

7. The device set forth in claim 1 wherein said second elongate member is provided at said one end with a receptacle for receiving paint scrapings.

8. The device set forth in claim 7 wherein said second elongate member is further provided at said one end with a coupling for connecting a hose to said second elongate member so that said hose communicates with said receptacle.

9. The device set forth in claim 1 wherein said first elongate member is a telescoping member.

10. A method for removing paint from a surface facing at least partially downwardly, said method comprising:

providing a paint removal device having a first elongate member with an upper end and a lower end, a second elongate member with two ends, a joint or articulation connecting said upper end of said first elongate member to said second elongate member at a point therealong spaced from the ends of said second elongate member wherein said joint or articulation includes a fixed element preventing translation of said second elongate member relative to said first elongate member, and a scraper blade provided on said second elongate member at one end thereof;

planting said lower end of said first elongate member on a ground or floor surface below an at least partially downwardly facing painted surface;

pivoting said second elongate member at said joint or articulation to place said scraper blade in contact with said painted surface;

after pivoting of said second elongate member about said joint or articulation to place said scraper blade in contact with said painted surface, pulling on said second elongate member to pivot said first elongate member and said second elongate member about an axis passing through said lower end of said first elongate member; and during the pulling on said second elongate member, maintaining said scraper blade in forceful contact with said painted surface, to thereby scrape paint from said painted surface.

11. The method set forth in claim 10 wherein:

said joint or articulation defines a first rotation axis and a second rotation axis oriented perpendicularly to one another and to said first elongate member;

said first rotation axis is oriented parallel to said second elongate member, said second rotation axis is oriented substantially perpendicularly to said second elongate member, and the pivoting of said second elongate member about said joint or articulation includes pivoting said second elongate member about said second rotation axis, further comprising pivoting said second elongate member about said first rotation axis to maximize engagement between said scraper blade and said painted surface.

12. The method set forth in claim 11 wherein the pivoting of said second elongate member about said first rotation axis is executed prior to the pulling on said second elongate member.

13. The method set forth in claim 10 wherein said painted surface is a surface of a boat hull, further comprising elevating said boat hull above said ground or floor surface prior to the planting of said first elongate member on said ground or floor surface.

14. The method set forth in claim 10, further comprising attaching a hose to said one end of said second elongate member and suctioning paint scraping through said hose during a paint scraping procedure.

15. A paint removal device comprising:

a first elongate member having two ends;

a second elongate member having two ends;

a joint connecting an end of said first elongate member to said second elongate member at a point therealong spaced from the ends of said second elongate member, said joint permitting pivoting of said second elongate member about at least two distinct axes, said joint including structure enabling pivoting of said second elongate member relative to said first elongate member about two distinct axes only, said axes being oriented substantially perpendicularly to one another and to said first elongate member, said second elongate member having a longitudinal axis, said joint including a collar, said second elongate member traversing said collar so that said second elongate member is rotatable about said longitudinal axis, said longitudinal axis being one of said two distinct axes; and a scraper blade provided on said second elongate member at one end thereof.

* * * * *